US005550431A

United States Patent [19]

Duggan et al.

[11] Patent Number: 5,550,431

[45] Date of Patent: Aug. 27, 1996

[54] HIGH PRESSURE ARC DISCHARGE LAMP HAVING BARIUM HAFNATE IMPREGNATED ELECTRODES

[75] Inventors: George L. Duggan, Manchester, N.H.; David A. Goodman, Amesbury, Mass.

[73] Assignee: Osram Sylvania Inc., Danvers, Mass.

[21] Appl. No.: 435,261

[22] Filed: May 5, 1995

[51] Int. Cl.[6] ..... H01J 17/04; H01J 61/073

[52] U.S. Cl. ..... 313/630; 313/633; 313/346 R; 313/491; 313/311; 252/521; 445/51

[58] Field of Search ..... 313/633, 346 R, 313/491, 311, 630, 628; 252/521; 445/51

[56] References Cited

U.S. PATENT DOCUMENTS

| | | | |
|---|---|---|---|
| 2,843,801 | 7/1958 | Krefft | 315/48 |
| 3,886,391 | 5/1975 | Koury et al. | 313/633 |
| 4,044,276 | 8/1977 | Keeffe et al. | 313/218 |
| 5,111,108 | 5/1992 | Goodman et al. | 313/630 |
| 5,138,224 | 8/1992 | Goldburt et al. | 313/346 R |

*Primary Examiner*—Michael Horabik
*Assistant Examiner*—Michael Day
*Attorney, Agent, or Firm*—William H. McNeill

[57] ABSTRACT

An electron emitting, barium hafnate material for arc discharge lamp electrodes is manufactured by the method comprising the steps of: forming a mixture of barium carbonate and hafnium oxide in a 48 to 52 mole ratio; adding the mixture to a suitable carrier to form a slurry; ball milling the slurry for about 2 hours to form a powder mix; drying the powder mix; firing the dried powder mix in air at about 1500° C. for about 22 hours to produce a product; and vibration milling the product in methanol with zirconia media to produce the barium hafnate. The latter material is then preferably vacuum impregnated into a tungsten electrode and hydrogen fired to produce a single phase barium oxide/hafnium oxide compound.

5 Claims, 3 Drawing Sheets

HIGH PRESSURE ARC DISCHARGE LAMP HAVING BARIUM HAFNATE IMPREGNATED ELECTRODES

TECHNICAL FIELD

This invention relates to high pressure arc discharge lamps such as mercury lamps and high pressure sodium lamps and particularly to a new electrode coating for such lamps.

BACKGROUND ART

U.S. Pat. No. 2,843,801 has disclosed the efficacy of hafnium oxide as an electron emitting material and U.S. Pat. No. 4,044,276 discloses emitter materials composed of barium oxide, calcium oxide and hafnium oxide. Attempts to employ the latter material, while successful, have problems due to moisture reaction. This material was coated on electrodes as the carbonates and oxides and subsequently fired in hydrogen or vacuum to decompose the carbonates to the oxides. However, after firing, it has been discovered that the materials can deteriorate rapidly when exposed to ambient atmosphere. Calcium oxide can react vigorously and exothermally with water vapor while the calcining of barium carbonate is an equilibrium reaction, thus:

$$BaCO_3 \leftrightarrows BaO + CO_2$$

and, while this reaction can be driven to the right, exposure to $CO_2$ after firing can result in the re-formation of $BaCO_3$.

DISCLOSURE OF THE INVENTION

It is, therefore, an object of this invention to obviate the disadvantages of the prior art.

It is another object of the invention to enhance the operation of high intensity discharge lamps.

Yet another object of the invention is the improvement of electrodes for such lamps.

These objects are accomplished, in one aspect of the invention, by the provision of a method of making an electron emitting, barium hafnate material for arc discharge lamp electrodes comprising the steps of: forming a mixture of barium carbonate and hafnium oxide in a 48 to 52 mole ratio; adding said mixture to a suitable carrier to form a slurry; ball milling said slurry for about 2 hours to form a powder mix; drying said powder mix; firing said dried powder mix in air at about 1500° C. for about 22 hours to produce a product; and vibration milling said product in methanol with zirconia media to produce said barium hafnate.

Applying the barium hafnate to a suitable electrode is accomplished by forming an emission mix slurry as is known in the art and impregnating the electrodes therewith. Vacuum impregnation of the electrodes form a slurry of methanol is preferred. After coating, the electrode is allowed to dry and any excess oxide material are cleaned off. The coated electrodes are then fired at 1600° C. to form the oxides. This procedure insures complete reaction of the oxides and prevents the re-formation of the carbonates.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
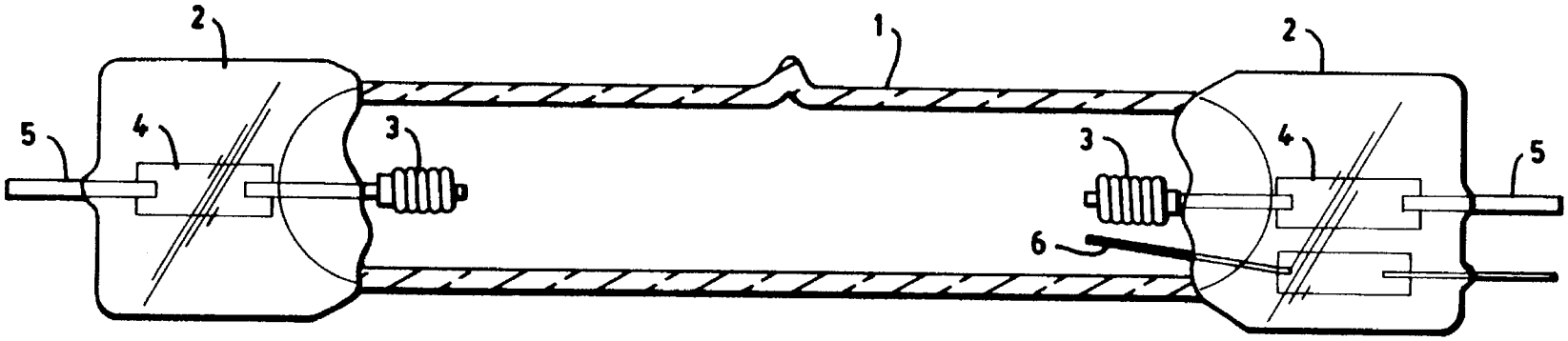
FIG. 1 is an elevational view, partially in section, of one form of arc tube which can employ the invention.

Referring now to the drawings with greater particularity, there is shown in FIG. 1 an arc tube 1 made of a high silica glass such as quartz, having press seals 2 at each end thereof. At each end of arc tube 1 is an electrode 3 which is connected to a molybdenum ribbon 4 which is connected, in turn, to an external lead wire 5. The arc tube has a starting electrode 6 as is known in the art. The electron emitting composition of this invention is disposed on each electrode 3.

Figure 2:
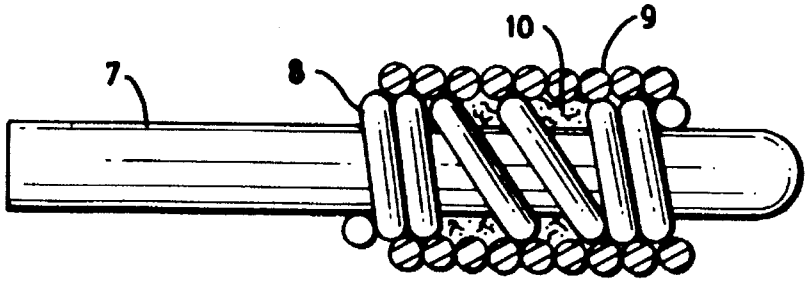
FIG. 2 is an expanded view of an electrode.

In one embodiment of electrode 3, as shown in FIG. 2, the electrode comprises a tungsten rod 7 having inner tungsten coil 8 thereon encircling a portion of rod 7 and secured thereto. Outer tungsten coil 9 is threaded on coil 8. The emitting material 10 of this invention disposed in the recesses between coils 8 and 9. Coil 8 may have some open turns, as shown in FIG. 2, to accommodate more emitter material.

The emitter material was prepared by making an electron emitting, barium hafnate material for are discharge lamp electrodes which comprised the steps of: forming a mixture of barium carbonate and hafnium oxide in a 48 to 52 mole ratio; and adding the mixture to a suitable carrier to form a slurry. In the preferred form of the invention the slurry material is methanol; however, other volatile carriers, such as water, ethanol or butyl acetate can be used. The slurry is then ball milled for about 2 hours using zirconia media, to form a powder mix. This powder mix is then dried and fired in air at about 1500° C. for about 22 hours to produce a single phase barium hafnate with a slight excess of hafnia. This product is then mixed in methanol and vibration milled with zirconia media to produce a slurry with a mean particle diameter of 3.5 micrometers The barium hafnate is then prepared with an emission slurry, as is known in the art, and vacuum impregnated into the electrodes 3. The now coated coils are allowed to dry and any excess oxides which may be present are cleaned from the coils. The coils are then fired in hydrogen at about 1400° to 1700° C. to sinter the electrodes. The preferred temperature is about 1600° C. Employing this procedure provides for the creation of single phase barium hafnate with a slight excess of hafnia which effectively prevents the reformation of the carbonates, or reaction with atmospheric moisture.

Figure 3:
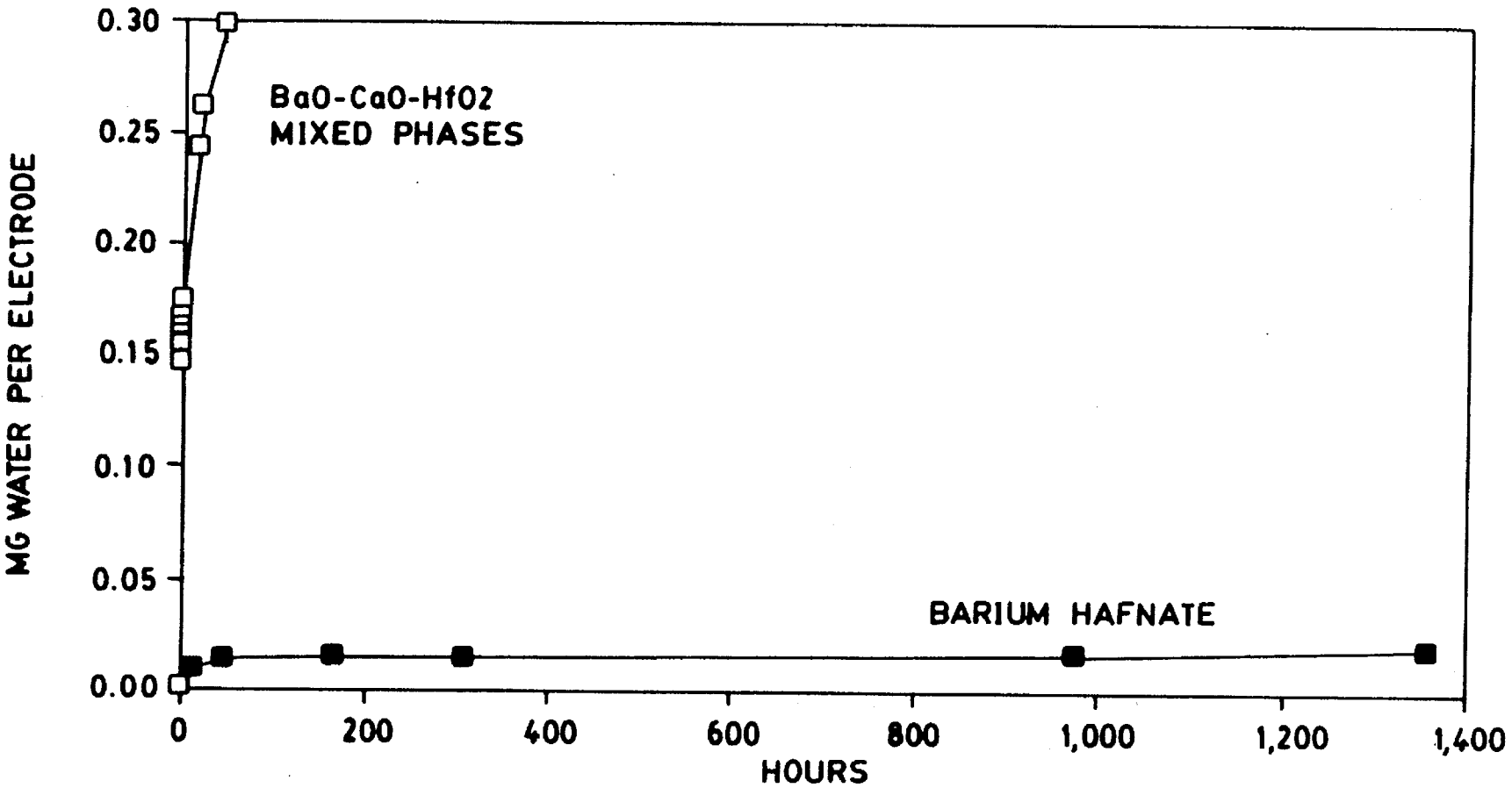
FIG. 3 is a graph of the moisture reaction of barium hafnate compared to the prior art emitter.

Measurements have been made of the moisture reaction of the prior art (as epitomized in U.S. Pat. No. 4,044,276) and the composition described herein. Coated coils were prepared in accordance with the procedures described above and exposed to air with a fixed relative humidity of 57% at room temperature. The results, as shown in FIG. 3, reveal that the new compostion reacts with the atmosphere 400 times slower than the prior art.

The advantages of the invention can also be obtained by using other precusor materials such as the hydroxides, nitrates, oxalates or other materials which react in oxygen and heat to form oxides.

Figure 4:
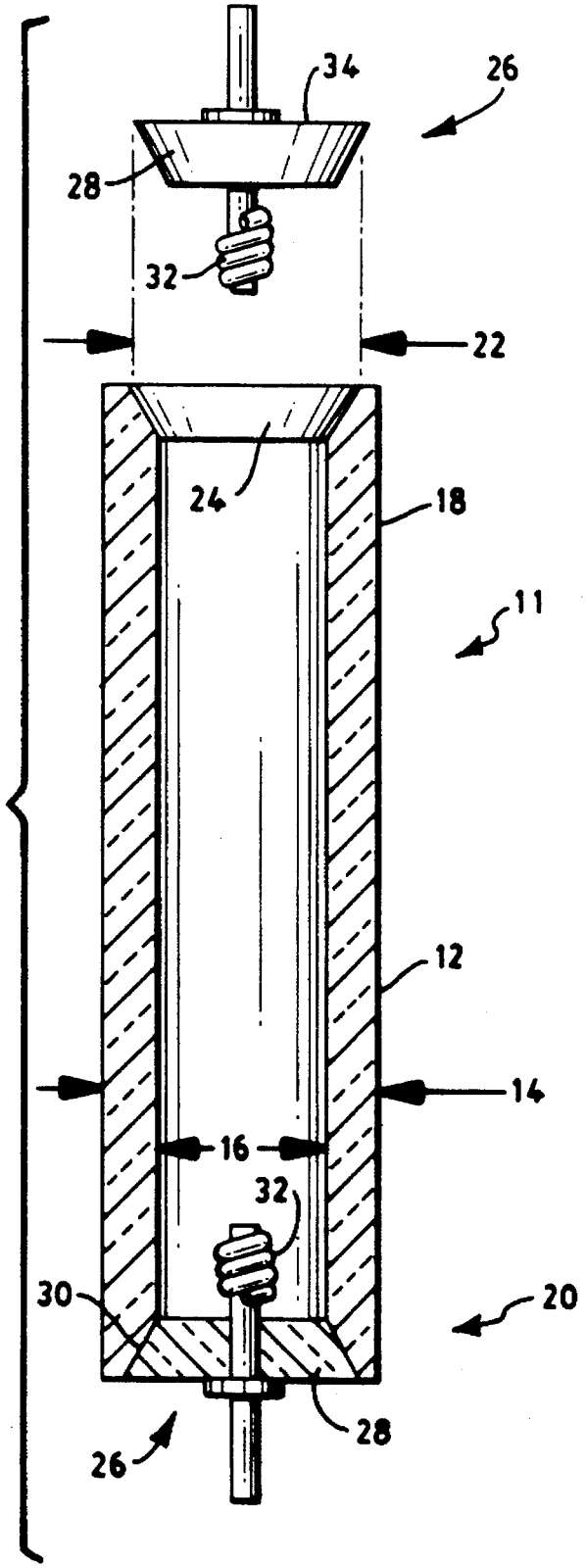
FIG. 4 is an elevational view, in section, of a second form of arc tube which can employ the invention.

Referring now to FIG. 4, there is shown one form of a sodium lamp arc tube 11 which comprises a ceramic cylindrical body 12 having an outside diameter 14 and an inside diameter 16. Adjacent the ends 18 and 20 the inside diameter widens to form an intermediate diameter 22 which is greater than diameter 16 but less than diameter 14, thus forming a chamfer 24.

A sealing disk 26, which includes a fusto-conical portion 28 formed to mate with chamfer 24 is sealed into each end of body 12 by means of a sealing material 30 which forms a sealing annulus.

An electrode 32, which can be a conventional electrode for a high pressure sodium lamp including the electron emissive material of this invention, is sealed into a centrally located aperature in disk 26. A wire stop 34 can hold electrode 32 in position.

While there have been shown an described what are at present considered the preferred embodiments of the invention, it will be apparent to those skilled in the art that various changes and modifications can be made herein without departing from the scope of the invention as defined by the appended claims.

What is claimed is;

1. A method of making an electron emitting, barium hafnate material for arc discharge lamp electrodes comprising the steps of: forming a mixture of barium carbonate and hafnium oxide in a 48 to 52 mole ratio; adding said mixture to a suitable carrier to form a slurry; ball milling said slurry for about 2 hours to form a powder mix; drying said powder mix; firing said dried powder mix in air at about 1500° C. for about 22 hours to produce a product; and vibration milling said product in methanol with zirconia media to produce said barium hafnate.

2. The method of claim 1 wherein said suitable carrier is selected from the group consisting of: water, ethanol, butyl acetate, or methanol.

3. The method of claim 1 wherein said barium hafnate is impregnated on an arc tube electrode; the electrode is dried and cleaned of any excess oxide materials; and the electrode is fired in hydrogen at a temperature of about 1400° C. to about 1700° C. to sinter said electrode.

4. In a high pressure arc discharge tube having a main electrode at each end thereof and containing a fill of an arc generating and sustaining medium, the improvement comprising an electron emitting material on said electrodes comprising barium oxide and hafnium oxide and wherein said oxides were deposited as barium hafnate.

5. The arc tube of claim 4 wherein said electrode comprises a tungsten rod having two concentric encircling coils thereon and said material is disposed between said coils.

* * * * *